United States Patent [19]

Frechette

[11] 3,980,171

[45] Sept. 14, 1976

[54] RIBBON CARTRIDGE

[75] Inventor: Thomas E. Frechette, Windsor Locks, Conn.

[73] Assignee: Royal Business Machines, Inc., Hartford, Conn.

[22] Filed: May 27, 1975

[21] Appl. No.: 581,206

[52] U.S. Cl. ..... 197/151; 197/168; 226/158; 197/170; 242/197

[51] Int. Cl.[2] ..... B41J 35/23

[58] Field of Search ..... 242/195, 197; 226/157, 226/158; 197/168, 170, 151, 153, 159, 181

[56] References Cited

UNITED STATES PATENTS

| | | | |
|---|---|---|---|
| 3,155,216 | 11/1964 | Talmage | 197/181 |
| 3,157,264 | 11/1964 | Frechette | 197/16 |
| 3,279,666 | 10/1966 | Graves | 226/158 |
| 3,537,630 | 11/1970 | Reinmann | 226/158 |
| 3,604,657 | 9/1971 | Igarashi et al. | 242/195 |
| 3,643,779 | 2/1972 | Anderson et al. | 197/159 |
| 3,677,452 | 7/1972 | Wallace | 226/157 |
| 3,830,351 | 8/1974 | Cappotto | 197/151 |
| 3,904,017 | 9/1975 | Frechette | 197/170 |
| 3,927,747 | 12/1975 | Wolowitz | 197/151 |

OTHER PUBLICATIONS

Carpenter, "Ribbon Cartridge" IBM Technical Disclosure Bulletin vol. 17 No. 4 p. 1118 Sept. 1974.

*Primary Examiner*—Robert E. Bagwill
*Assistant Examiner*—William Pieprz
*Attorney, Agent, or Firm*—Joseph R. Spalla

[57] ABSTRACT

A top loading ribbon cartridge having a threaded ribbon guide for directing ribbon in the cartridge out of and back into the cartridge which is mountable on one side of a machine printing point. The threaded ribbon guide is movable relative to the cartridge from a retracted position away from the printing point to an extended position to expose ribbon in front of the printing point incident to typing actions. The movement of the ribbon guide is in a lateral direction which permits the mounting of a similar cartridge on the opposite side of the printing point which may contain error correction ribbon or ribbon of a different color in readiness for operation under operator control.

6 Claims, 5 Drawing Figures

RIBBON CARTRIDGE

This invention relates to ribbon cartridges for use in typewriters or like machines; more particularly, it relates to a ribbon cartridge including a ribbon guide and ribbon indexing mechanism which are automatically coupled to typewriter vibrator and feed mechanism when the cartridge is top loaded in the machine; and specifically, it relates to a cartridge in which the ribbon guide is movable from a retracted position within the cartridge to an extended position to place an exposed part of the ribbon carried by the guide in front of a printing point.

Ribbon cartridges to facilitate mounting and replacement of ribbon in typewriters are known in the prior art. Included in the prior art are ribbon cartridges with attached prethreaded ribbon guides which are couplable to mechanism in a machine to move the guided ribbon to and from a printing point. An early example of the latter is shown in U.S. Pat. No. 785,709 to Burridge wherein the cartridge and threaded guide assembly is inserted upwardly from the rear of the machine. A more recent example is shown in U.S. Pat. No. 3,643,777 to Carl P. Anderson et al.

While prior art cartridges facilitate ribbon insertion and changing, they require a number of manipulative steps to change from one color ribbon to another as, for example, when an error occurs and has to be obliterated, the operator must remove the inked ribbon cartridge, insert an error correction ribbon cartridge, and, following error correction, must remove the error correction ribbon cartridge and reinsert the inked ribbon cartridge. The time required to carry out these manipulative steps breaks typing rhythm and slows down the typing of a document. The necessity for such steps stems from the fact that the ribbon guides extend to a plane in the area of the printing point which cannot be shared by two swinging ribbon guides.

In accordance with the present invention, there is provided a ribbon cartridge including a ribbon guide for directing ribbon out of and back into the cartridge which is mounted for movement relative to the cartridge in a lateral or straight line direction from a retracted position to an extended position to expose ribbon in front of a printing point. In that the movement of the ribbon guide is in a lateral straight line direction, two cartridges can be mounted in a machine on either side of the printing point and selectively coupled under operator control to machine mechanism to type through the ribbon in either cartridge. Thus, to correct a typed error, a typist need only strike a mode switch to condition error correction ribbon in one cartridge for operation, and, after error correction, to again condition the inked ribbon for operation without manipulation of either cartridge in the machine.

A feature of the invention resides in the fact that with error correction and inked ribbon cartridges of the invention mounted in a machine, when the inked ribbon is exhausted, only the inked ribbon cartridge need be replaced with no thought to the other cartridge. This is to be distinguished from some systems, as for example that disclosed in co-pending application Ser. No. 475,652 of Thomas E. Frechette, wherein cartridges support both an error correction ribbon and an inked ribbon. In such systems, when the inked ribbon is exhausted, unused error correction ribbon is thrown away. By employing separate cartridges for error and inked ribbons, any remaining error correction or other color ribbon in the ribbon cartridge on the opposite side of the printing point can remain to be completely used and thereby avoid wasting unused error correction ribbon when the inked ribbon is exhausted.

An object of the invention is to provide a ribbon cartridge including means for guiding ribbon therein to and from a printing point which can be easily loaded in a typewriter or like machine.

Another object of the invention is in the provision of a ribbon cartridge including means for guiding ribbon to and from a printing point in which the guide means is oscillated from a retracted position away from the printing point to an extended position in front of the printing point in a straight line direction.

Another object of the invention is in the provision of a top loading ribbon cartridge which includes guide means for directing ribbon out of and back into a cartridge mounted to one side of the printing point which guide means is movable toward and away from a printing point whereby two such cartridges may be mounted in the machine on either side of the printing point with no interference of their respective ribbon guides in the area of the printing point.

Other objects and many of the attendant advantages of the present invention will be readily appreciated as the same becomes better understood by reference to the following detailed description when considered in connection with the accompanying drawing in which like reference numerals designate like or corresponding parts throughout the Figures thereof and wherein.

Figure 1:
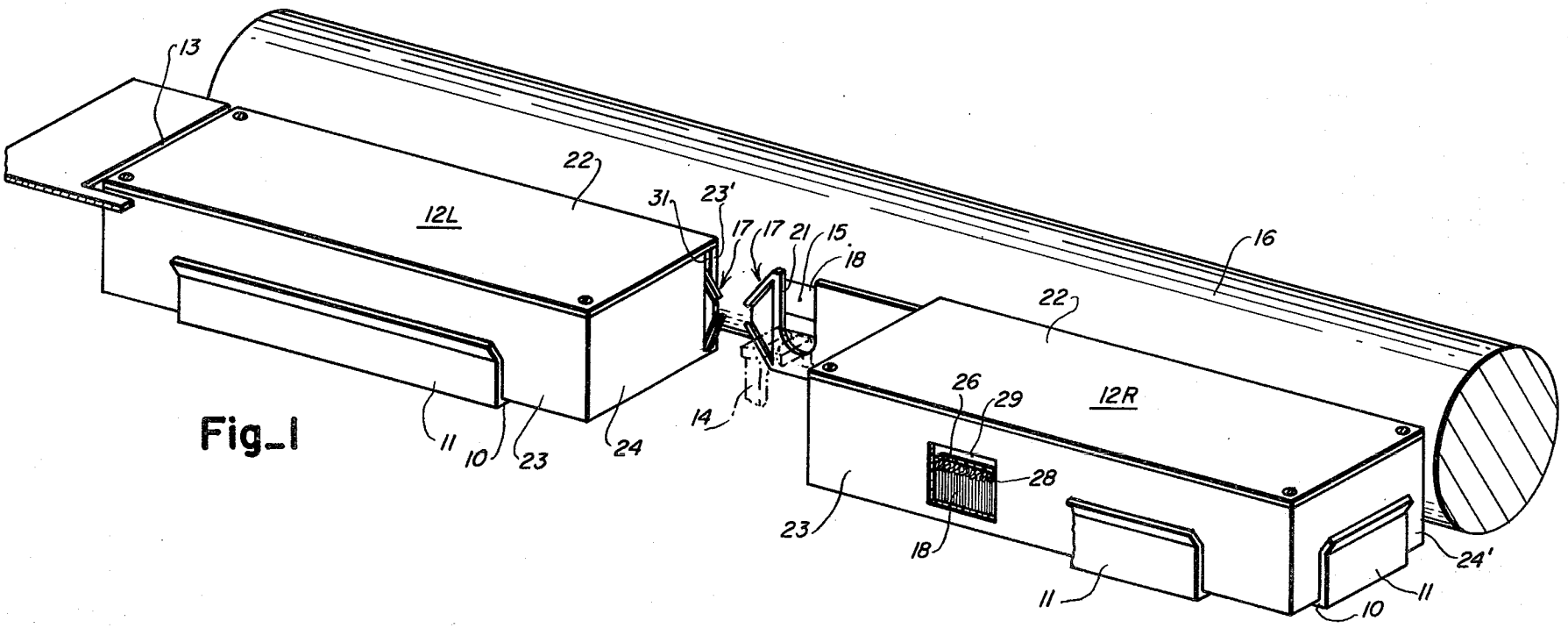
FIG. 1 is a perspective view showing a pair of ribbon cartridges mounted in a typewriter to either side of a printing point with the ribbon guide of the right cartridge extended to the printing point.

Referring now to the drawing wherein a preferred embodiment of a ribbon cartridge is illustrated, there is shown in FIG. 1 elements 10 of a typewriter frame which are formed with upwardly directed portions 11 to receive and locate ribbon cartridges generally designated by reference numerals 12R and 12L. In the preferred embodiment, the cartridges may be inserted as by top loading into top cover openings 13 to either side of a conventionally supported type bar guide 14 which is aligned with a vertical through the printing point 15 of the typewriter. The typewriter frame also supports a platen 16 for movement relative to the printing point 15.

The cartridges 12R and 12L, other than being adapted for mounting in the left and right sides of the machine, may be identical and of any desired shape. Accordingly, the same reference numerals are applied to each of the cartridges 12R and 12L in the drawing. As shown in FIG. 1, each cartridge includes and supports a ribbon guide generally designated by reference numeral 17 for lateral straight line movement from a retracted position, as shown by the guide 17 mounted in the left cartridge 12L, to an extended position, as shown by the guide 17 mounted in the right cartridge 12R in FIG. 1, to place ribbon 18 spanning a window or opening 21 in the ribbon guide 17 opposite the printing point 15. As will be appreciated from FIG. 1, the retracted ribbon guide 17, mounted in the left cartridge 12L, is removed from the area of the printing point 15 and does not interfere with the ribbon guide 17 of the right cartridge 12R when in the extended position. Accordingly, both cartridges can be placed in the machine in readiness for use as desired under operator control.

Figure 2:
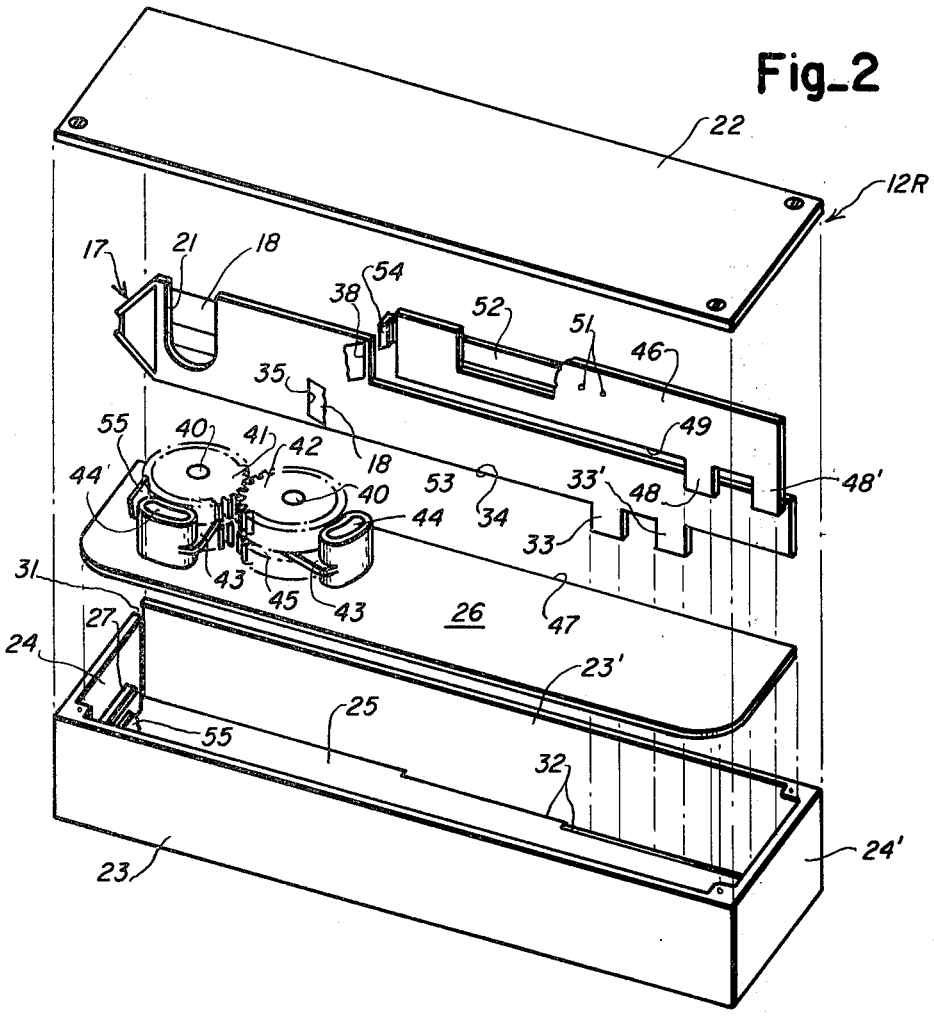
FIG. 2 is an exploded perspective view of a ribbon cartridge.
Figure 5:
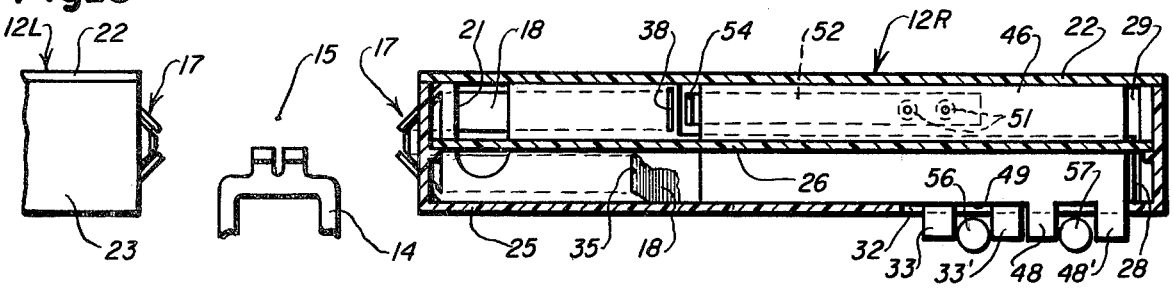
FIG. 5 is a cross-sectional view taken along lines 5—5 of FIG. 4.

With reference now to FIG. 2, a cartridge comprises a upper wall 22, side walls 23, 23', end walls 24, 24', a parallel bottom wall 25 and a parallel divider wall 26 supported by abutments 27, as needed, on the inside of the end 24, 24' and/or side 23, 23' walls. The divider wall 26 divides the space between the upper and bottom walls into vertically spaced chambers 28 and 29 (FIGS. 1 and 5).

As shown in FIG. 2, the ribbon guide 17 extends rightwardly and is guided for lateral movement by a vertical slot 31 in the end wall 24 adjacent the side wall 23' and by slots 32 in the bottom wall 25 through which spaced drive lugs 33, 33' formed on the lower edge 34 of the ribbon guide 17 extend.

Figure 3:
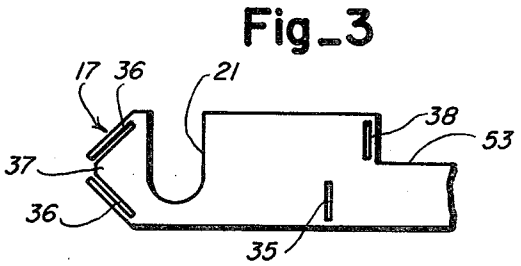
FIG. 3 is a partial elevational view of the ribbon guide showing the turn around end structure.
Figure 4:
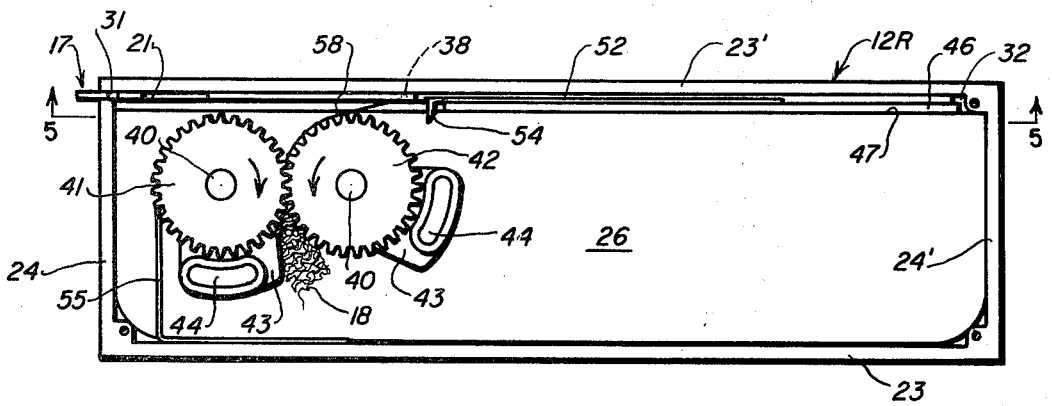
FIG. 4 is a top view of a cartridge with the cover removed.

With reference to FIGS. 1 and 2, a supply of ribbon 18, preferably fan folded, is housed in the lower chamber 28 and extends therefrom through a slot 35 in the ribbon guide 17 opposite the lower chamber 28, to the left, past the window 21, and, with reference to FIG. 3, through 45° converging slots 36 in the terminal end 37 of the ribbon guide 17 whereby its direction is reversed. From the terminal end, the reversely directed ribbon 18 again extends past the upper portion of window 21, through another slot 38 in the ribbon guide 17 opposite the upper chamber 29 and then between an idler 41 and a drive ribbon take-up gear 42 rotatably mounted on pins 40 extending upwardly from the divider wall 26. When indexed, the gears serve to draw used ribbon 18 into the upper chamber 29. With reference to FIGS. 2 and 4, the gears are associated with C-clips 43 mounted on upright posts 44 formed in the divider wall which clips 43 embrace circumferential slots 45 in the gears 41 and 42 and serve as ribbon shedders.

Also, as best seen in FIG. 2, a ribbon feed slide 46 is also laterally movably supported in the cartridge 12R, guided between the ribbon guide 17 and the rear edge 47 of the divider wall 26 and which is provided at its right end with spaced drive lugs 48, 48' depending from its lower edge 49.

Secured rearwardly of the feed slide as by pins 51 is a flexible member 52 which is accommodated by the narrower width of the ribbon guide 17 to the right of slot 38 formed by cutting back the top edge 53 of the ribbon guide 17.

The left most end of the flexible member 52 is bent forwardly to form a drive tooth 52 which, when the feed slide 46 is moved to the left, will, as best viewed in FIG. 4, engage and drive the take-up drive gear 42. A no back pawl 55 formed on or secured to and extending from the side wall 23 engages the idler gear 41 to prevent rotation of the gears 41, 42 during the return stroke of the pawl tooth 54.

As best seen in FIG. 5, the spaced lugs 33, 33' and 48, 48', respectively, of the ribbon guide 17 and the feed slide 46 are adapted, when a cartridge 12 is top loaded in the machine, to embrace respectively a guide extender rod 56 and a feed slide extender rod 57 which will be acutated respectively by a U-bar and an action initiated by U-bar movement as is conventional, which are operative incident to type actions whereby, in sequence, the ribbon guide 17 will be extended, the feed slide 46 will be extended to feed ribbon 18 one increment, after which printing through the ribbon 18 opposite the window 21 will occur. Thereafter, the feed slide 46 will be withdrawn back into the cartridge 12 and the ribbon guide 17 also, unless a second type action, initiated before its return, is in progress.

Referring again to FIG. 4, the stroke of the ribbon guide 17 from retracted to extended position is such that the length of the ribbon portion 58 between slot 38 and the nip of the take-up gears 41, 42 does not change and is, therefore, at no time under stress as would impede the stroke of the ribbon guide 17. In other words, the geometry is chosen such that the distance between the nip of the gears 41, 42 and the slot 38 in the retracted and extended positions will not change.

As will be understood, a machine employing cartridges 12R and 12L, as described herein, will also have drive rods similar to rods 56 and 57 in the left side of the machine which, when the left cartridge ribbon 12L is to be used, will be enabled as by being coupled to type action driven mechanisms, while the right drive rods 56, 57 will be disabled as by being decoupled from the type action driven mechanisms. Such enabling and disabling of the connections between the left and right drive rods and type action mechanisms, which form no part of the present invention, will be initiated by an operator controlled mode key. Further, in order that the writing line opposite the cartridge 12L be clearly visible, the left cartridge 12L may be held below the writing line and raised to the position shown in FIG. 1 by suitable mechanism associated with the left cartridge enabling mechanism.

The invention claimed is:

1. A ribbon cartridge adapted to be top loaded into a receptacle on a typewriter to one side of the printing point comprising a housing having a supply and take-up chamber, a supply of ribbon supported in said supply chamber, ribbon threaded guide means in said housing carrying ribbon from said supply chamber to said take-up chamber, said guide means having an opening to expose a portion of ribbon opposite said printing point, said guide means being movably supported in said housing for movement from a retracted position within said housing to an extended position outside said housing to place said opening opposite said printing point, and means for moving said guide means in a lateral straight line movement between retracted and extended positions.

2. A ribbon cartridge as recited in claim 1, further including means in said cartridge to withdraw ribbon from said supply chamber comprising feed gears rotatably supported in said take-up chamber, pawl means movably supported in said housing for indexing said gears, and means for moving said pawl means in a lateral straight line movement toward and into indexing engagement with said feed gears and away from said feed gears.

3. A ribbon cartridge as recited in claim 1, said guide means having an end formed to reverse the direction of ribbon extending between said supply and take-up chambers, a first slot for directing ribbon from said supply chamber to said turn around end, and a second slot for directing ribbon tracked around said end into said take-up chamber.

4. A ribbon cartridge as recited in claim 1, said supply and take-up chambers being vertically spaced.

5. A ribbon cartridge as recited in claim 1, said ribbon in said supply chamber being fan folded.

6. A ribbon cartridge as recited in claim 1, said housing having an opening to guide said guide means between retracted and extended positions.

* * * * *